United States Patent [19]

Lynch

[11] Patent Number: 4,733,732

[45] Date of Patent: Mar. 29, 1988

[54] SUBMUDLINE DRIVEPIPE WHIPSTOCK METHOD AND APPARATUS

[75] Inventor: Samuel C. Lynch, Houston, Tex.

[73] Assignee: Atlantic Richfield Company, Los Angeles, Calif.

[21] Appl. No.: 72,951

[22] Filed: Jul. 13, 1987

Related U.S. Application Data

[63] Continuation of Ser. No. 761,733, Aug. 2, 1985, abandoned, which is a continuation-in-part of Ser. No. 565,680, Dec. 27, 1983, abandoned.

[51] Int. Cl.[4] ..... E21B 7/136; E21B 7/06; E21B 7/20

[52] U.S. Cl. ..... 175/9; 166/277; 175/61; 175/80; 175/82

[58] Field of Search ..... 175/9,5, 8, 61, 78–82; 166/117.6, 384, 50, 98, 242, 277, 380, 341, 362

[56] References Cited

U.S. PATENT DOCUMENTS

| | | | |
|---|---|---|---|
| Re. 29,929 | 3/1979 | Horvath | 175/9 |
| 2,145,422 | 1/1939 | Kinzbach | 166/117.6 |
| 3,095,039 | 6/1963 | Kinzbach | 175/81 X |
| 4,068,729 | 1/1978 | Peevey | 175/8 |

*Primary Examiner*—James A. Leppink
*Assistant Examiner*—Hoang C. Dang
*Attorney, Agent, or Firm*—Drude Faulconer

[57] ABSTRACT

In order to salvage a slot path on an offshore platform wherein the original conductor pipe has become clogged or otherwise rendered unusable, the original conductor is cut off below mudline, thereby leaving a stub forming a base upon which a suitably oriented deflector trough is attached. A new or replacement conductor is installed along the same slot path until the deflector trough causes the new conductor to follow a deviated path so as to avoid the original conductor. The direction of the deflector trough is selected to avoid existing wells already driven from such structure.

11 Claims, 6 Drawing Figures

SUBMUDLINE DRIVEPIPE WHIPSTOCK METHOD AND APPARATUS

This is a continuation of application Ser. No. 761,733, filed Aug. 2, 1985, which is a continuation-in-part of application Ser. No. 565,680, filed Dec. 27, 1983, both now abandoned.

BACKGROUND OF THE INVENTION

1. Field of the Invention

This invention relates generally to a method and apparatus for installing a well conductor from a fixed structure along a predetermined path.

2. Prior Art

Systems for installing conductors from multi-well offshore platforms along a deviated path are well known. Such systems enable an operator to obtain maximum bottom hole well spacing from a given fixed surface area. This spacing allows maximum well spacing from a minimum number of platforms.

One installation system is described in U.S. Pat. No. Re. 29,929 to Horvath. In this patent, for example, an irregularity, a so-called "dogleg", is welded to the bottom end of a vertically-extending string of conductor pipe at a slight angle. The irregular bottom initiates a lateral deviation of the downward path taken by the conductor below the mud line. This patent also lists and summarizes other prior art patents relating to the deviation or curvature of pipe conductors.

In drilling operations from a fixed structure, the conductor or drive pipe for a particular slot path may become clogged or damaged below the mud line, or may be proceeding along an interference path with an immobile object (such as another well bore). When this happens, an attempt may be made to correct the conductor pipe problems or salvage the slot by cleanout or shortening the existing conductor. If these measures, which are usually expensive, are unsuccessful, the slot will usually be abandoned as unusable. If sufficient slots are not available, then additional structures will have to be set to fully develop the field.

The present invention offers an alternative solution to this problem by utilizing a new method and apparatus for installing a replacement conductor pipe around said obstruction.

It is, therefore, a general object of this invention to devise a method and apparatus for salvaging a particular slot from a structure wherein the existing conductor for any number of reasons has become unusable.

It is a more particular object of this invention to provide such a method and apparatus wherein the salvage operation has a minimized cost and best success chance factor.

Other objects and advantages of this invention will become apparent from the detailed description to follow, taken in conjunction with the drawings and appended claims.

SUMMARY OF THE INVENTION

The present invention comprises a method and apparatus for installing a replacement well conductor (hereafter called "new conductor") around an obstruction in an original well conductor driven from an offshore platform (hereafter called "old conductor"). More particularly, in accordance with the method and apparatus of this invention, the old conductor is cut off below the water bottom or mudline, leaving an "old conductor stub". Then an upwardly facing deflector trough is attached to the old conductor stub and oriented so that the deflected path will be in a predetermined direction. The deflector trough itself remains above and outside the old conductor stub and is provided with attachment means that simply slide into or over the old conductor stub. In this way the deflector trough is positioned directly under the original slot path. The deflector and attachment means may be collectively termed a "submudline drivepipe whipstock" or "SDW". After the SDW is in place, the new conductor can be deflected by the deflector trough, thereby causing the conductors to bypass each other.

The preferred method of installing the SDW is by running it attached to the lower end of the new conductor. The new conductor is passed or driven downwardly through the same vertically spaced guide sleeves which guided the old conductor, so that the SDW is automatically aligned with the original slot path. Thus the SDW is self-guiding onto the old conductor stub where it becomes firmly seated. The means by which the SDW is attached to the new conductor are then sheared off by further downward movement of the new conductor. The deflector trough is positioned such that the bottom end of the new conductor contacts the inner curved surface of the trough. Thereafter, interaction between the new conductor and the deflector trough guides the new conductor into the substratum along a predetermined deviated path, the orientation of the trough controlling the direction in which the new conductor bypasses the old conductor. Any lateral bending to which the new conductor is subjected in this manner is distributed over the entire distance between the bottom guide sleeve and the top of the old conductor stub.

In an alternate embodiment, the SDW may be lowered into position in fixed relation to the old conductor as described above but at the end of a section of drill pipe. After the SDW assembly has been seated, the drill pipe may be released and withdrawn to allow installation of the new conductor, the deflector trough again being utilized to cause the desired predetermined deviation. This alternate embodiment also provides a backup method for the above described SDW placement or with retrieval should the SDW need to be recovered.

DETAILED DESCRIPTION OF THE PREFERRED EMBODIMENTS

Figure 1:
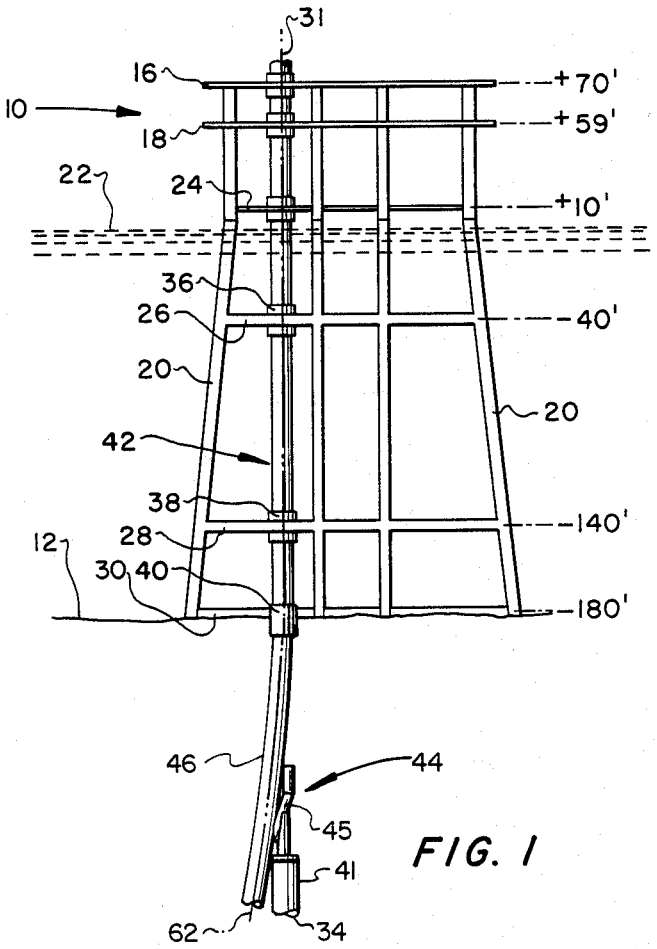
FIG. 1 is a generalized elevational view of a fixed structure (i.e. offshore platform) illustrating the new conductor in accordance with a preferred embodiment of this invention inserted through vertical guide sleeves and caused to deviate by the SDW assembly attached to the original conductor.

With particular reference now to FIG. 1, there is shown a conventional fixed structure 10 resting on the floor or mudline 12 of a body of water. The structure 10 includes: horizontal drill deck 16, production deck 18, and a plurality of cross-braced legs 20; the legs extend downward through water from water level 22 to the mudline 12. It is assumed that legs are anchored in place by piles extending through the legs or by other conventional means (not shown). It is also assumed that conventional drilling and production equipment (not shown) is located upon the respective decks 16 and 18. Legs 20 may be provided at vertical intervals with frames (such as frame 24, 26, 28, and 30) in order to provide necessary bracing and stability.

The fixed platform structure 10, such as is illustrated in FIG. 1, may accommodate a number of vertical "slots", a term which refers to well paths along which conductors are lowered or driven through the water into the substratum soil.

Figure 2:
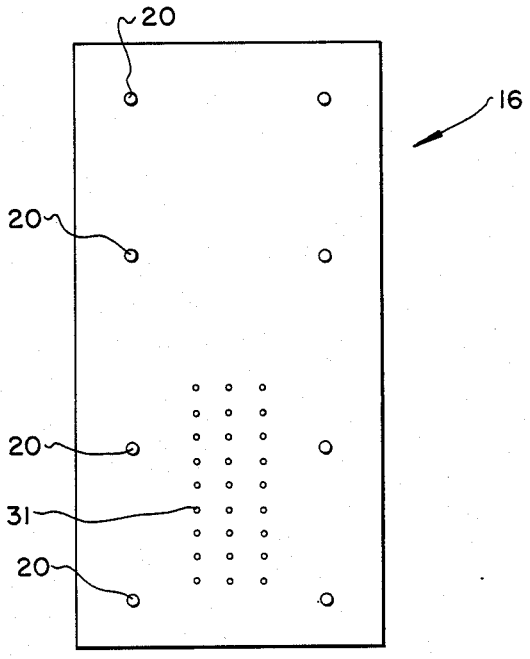
FIG. 2 is a diagram showing in plan the slot pattern of the fixed structure of FIG. 1.

In FIG. 2, twenty four such slots are indicated diagrammatically by circles, one such slot, for example, being indicated by the number "31". In the invention to be described for illustrative purposes, it is assumed that an original or "old conductor" 34 has been lowered or driven from fixed structure 10 along slot path 31 by passing through guide sleeves affixed to the various guide frames, for example, sleeves 36, 38, and 40, affixed respectively to frames 26, 28, and 30. As shown in FIG. 1, old conductor 34 has been cut off below mudline 12 to leave an open-ended stub 41, and the new conductor 42 has been installed in its place, as will be described in more detail. The abandonment of conductor 34 may have occurred through clogging or any of a number of reasons. For the purposes of this invention, it is sufficient to understand that conductor 34, and hence the slot path 31 which it follows, has been rendered useless at some point below the mudline 12. Therefore, if the slot 31 is to be salvaged for use, means must be devised for bypassing the old conductor 34 and doing so in a manner to avoid the pattern of existing wells.

Figure 5:
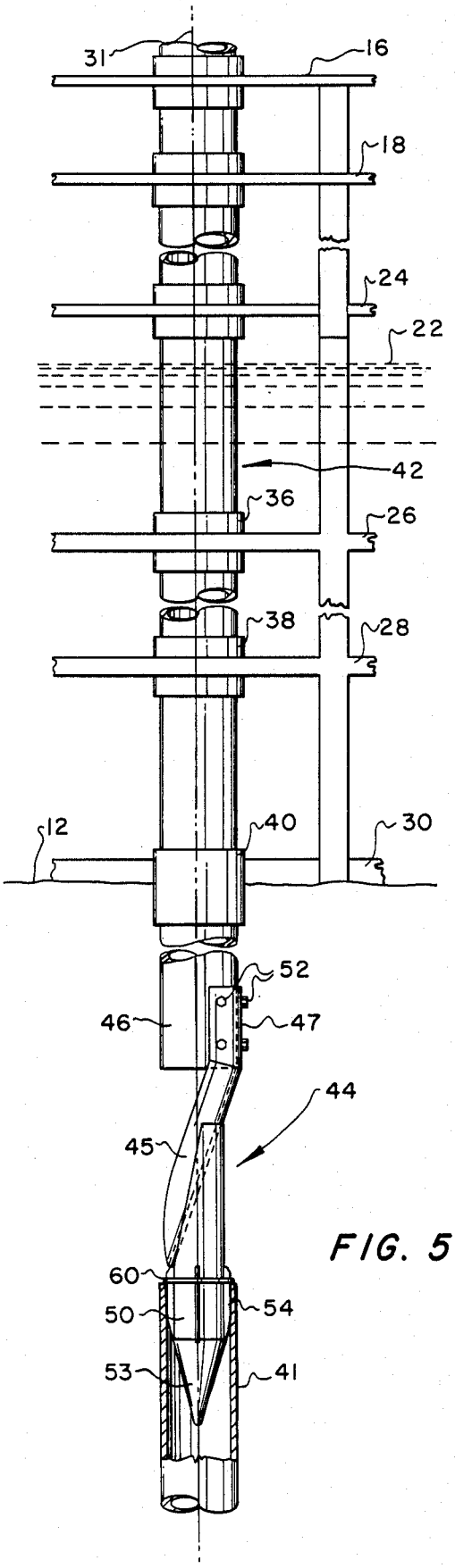
FIG. 5 is a side elevation of the SDW in accordance with the preferred embodiment of the method of this invention, indicating the primary method of SDW installation. The SDW is attached (bolted) onto the lower end of the new conductor.

In the practice of the method of this invention, a preferred apparatus is illustrated in FIG. 5. Adjacent the lower end of the new conductor 42 and configured to pass through the various guide sleeves of slot 31, as described above, there is fastened a SDW 44 consisting, in part, of upwardly facing deflector trough 45 fastened to the lower end 46 of the new conductor 42 by means of a vertical extension 47 of the deflector trough 45. The vertical extension 47 is attached to new conductor 42 by means of a plurality of transverse retained bolts 52. In this way, SDW 44 is releasably supported so that it extends beneath the new conductor 42. The stab-in shoe 50, FIG. 3, fixed to the under side of deflector trough 45 is also a part of SDW 44 and is the means for its attachment to the old, now abandoned original conductor stub 41 when sufficient internal diameter exists for insertion. The tapered shape nose 53 and ribs 54 allow ease of entry, but provide a very snug fit without creating an incompressible liquid problem.

Figure 3:
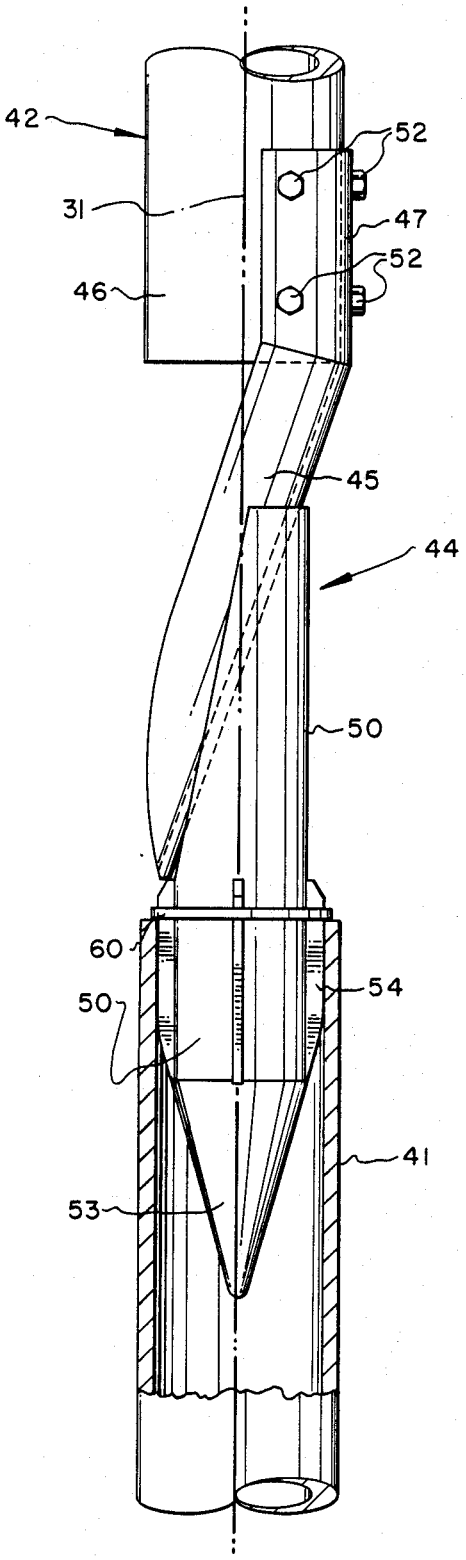
FIG. 3 is a detailed view of the SDW with a "stab-in" slidable attachment in accordance with a preferred embodiment of this invention. The "stab-in" bottom inserts into the old conductor stub.

In the practice of this invention, the original conductor 34 is cut off below the mudline 12 to leave an old conductor stub 41, the upper remaining portion having been removed by conventional means not forming part of this invention. With SDW assembly 44 carried beneath the new conductor 42, as shown in FIGS. 3 and 5, the new conductor 42 is lowered through the guide sleeves 36, 38, and 40 above and in concentric alignment with old conductor stub 41. The stab-in shoe 50 of SDW assembly 44 is then carefully lowered into the old conductor stub 41, "No Go" stop ring 60 on the SDW seats against the upper end of old conductor stub 41. During the aforementioned run-in of the SDW assembly 44, the face of the deflector trough 45 will be oriented by well-known means in order to produce deviation of new conductor 42 in a desired direction. In this way the existing pattern of known wells can be avoided.

In order now to continue the advance of new conductor 42, it is necessary to shear the retainer bolts 52. This may be accomplished through the weight of the new conductor 42 alone, but if this is not sufficient, additional force can be applied. Once the bolts 52 have been sheared, new conductor 42 will continue along a path started by the angle and orientation of deflector trough of the SDW.

Note with reference to FIG. 1, the downward movement of new conductor 42 relative to SDW assembly 44 will cause lower end of new conductor 46 to contact the inner curved surface of trough 45, at an angle selected by those skilled in this art to be nonsevere in frictional or laterally loading. This insures proper interaction between new conductor 42 and SDW assembly 44 that substantially eliminates the possibility that new conductor 42 may buckle and/or be crushed, causing the operation to fail. Thus, with the aid of the implanted SDW 44, the new conductor 42 may now be driven along a new path 62 to a desired location, in accordance with the illustration of FIG. 1.

The new conductor 42 is constrained against lateral bending until it extends below the bottom guide sleeve 40. Any lateral bending to which conductor 42 is subjected by interaction with deflector trough 45 is distributed over the entire distance between guide sleeve 40 and the top end of old conductor stub 41. Thus the severity of bend angle to which new conductor 42 is subjected may be controlled by the distance below mudline at which old conductor stub 41 is cut off. As a practical matter, stub 41 may not remain precisely in line with the original slot path along which it was driven. In fact, in yieldable, unconsolidated sea bottoms it may shift position in response to the pressure of new conductor 42, so that the actual bend angle of conductor 42 is further lessened. This is possible because the old conductor 34 is not confined in a wellbore. In this way the bend in new conductor 42 may be made so slight that path 62 remains almost parallel to the original slot path 31. Alternatively, conductor 42 may be made to follow a substantially deviated path by attaching a "dogleg" to its lower end in a manner well-known to the art. This represents a radical departure from the bend angle requirements to which rotary equipment is subjected in following the deflection required by a conventional whipstock confined within a wellbore in a side tracking operation.

Figure 4:
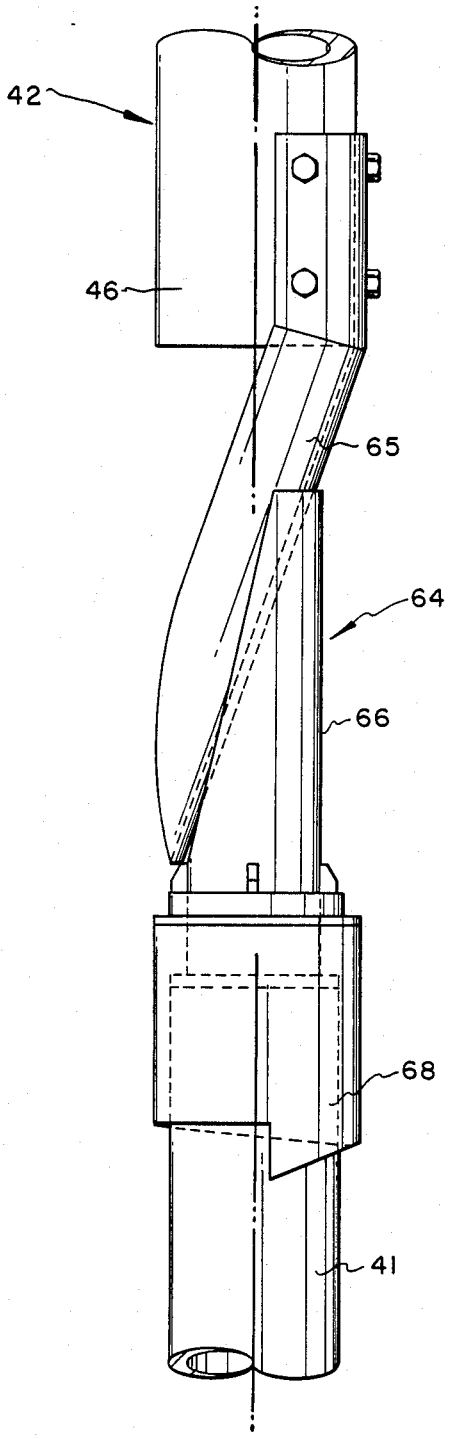
FIG. 4 is a detailed view of the SDW with a "stab-over" slidable attachment in accordance with an alternate embodiment of this invention. The "stab-over" bottom slides over the old conductor stub.

FIG. 4 illustrates an alternate embodiment of the apparatus of this invention utilizing different means for attaching SDW assembly 64 to enable a deviation of a new conductor from a fixed structure. As seen in FIG.

4, SDW assembly 64 comprises a slanted deflector trough 65 from which a stab-over shoe 68 is attached which slides over the old conductor stub 41 of an original abandoned conductor.

Figure 6:
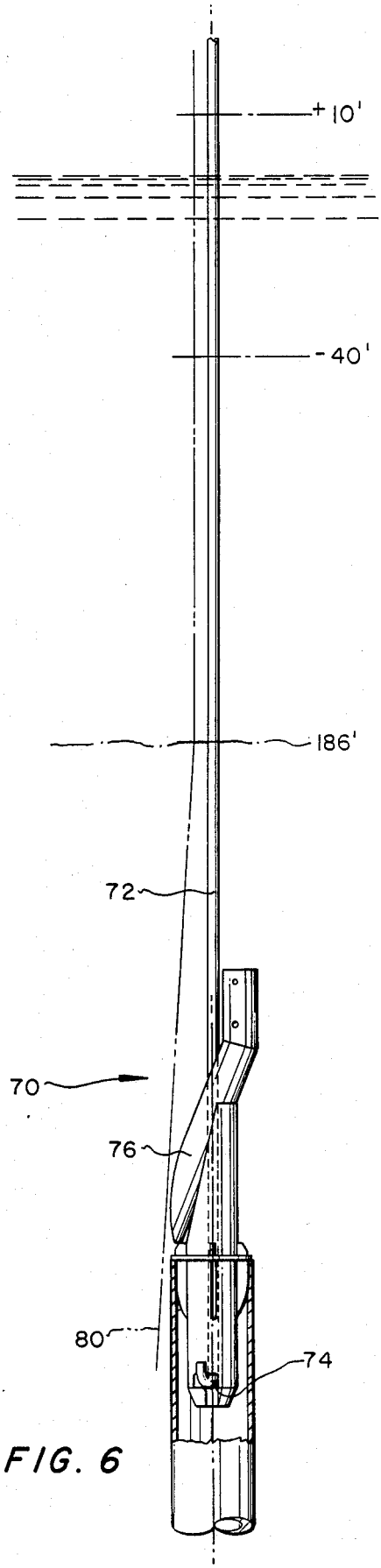
FIG. 6 is a side elevation, partially diagrammatic, of a still further embodiment of the method of this invention wherein the SDW is attached to the end of a section of drill pipe. This alternate method of attachment can also be used for retrieval of the SDW should operations be aborted.

In FIG. 6, an entire SDW assembly 70 is carried at the lower end of a string of drill pipe 72 with a 'J' slot 74 on which SDW assembly 70 may be lowered into position, or retrieved if an operation with above mentioned process must be aborted. In a well-known manner, a 'J' running tool inserted in the J slot 74 is rotated and/or released to enable the withdrawal of drill pipe 72. Thereafter, a new conductor (not shown) may be inserted through vertically-spaced guide sleeves (not shown) and lowered to make contact with deflector trough 76, causing the new conductor to follow a new path 80, as shown in dotted outline in FIG. 6.

In a typical salvage of a platform slot, in accordance with the embodiment of FIG. 1, the conductor pipe 34 or 42 may have an outside diameter twenty-four inches, the SDW shoe 50 for stab-in of the SDW assembly 44 may be twenty inches in outside diameter (FIG. 3) or for "slip-over" attachment section, the SDW shoe 68 is twenty six inches in inner diameter (FIG. 4). For fastening SDW 44 to new conductor 42, one may, for example, utilize nine and one-half inches by three inches ($9\frac{1}{2}\times3''$) A-307 steel bolts 52. In several offshore installations utilizing the method and apparatus of this invention old conductor stub 41 has been cut off approximately 75 feet below mudline. Using a 24" new conductor in pipe 42, the bend angle required is typically no more than 2 degrees per 100 feet.

It should be understood that the particular embodiments of this invention illustrated in the accompanying drawings and described in the foregoing detailed description are illustrative only. Therefore, the invention is not intended to be limited to the foregoing particulars, but may embrace other alternatives, equivalents, and rearrangements without departing from the scope and intent of the invention as more particularly set forth in the appended claims.

What is claimed is:

1. A method of installing a replacement well conductor from a fixed structure above a body of water to replace an abandoned well conductor previously installed from said structure along a predetermined path through said body of water so as to penetrate the substratum below the floor of said body of water comprising the steps of:

(a) severing said abandoned conductor at a predetermined depth below the floor of said body of water, said depth being such that the upper end of said abandoned conductor will yield under lateral pressure;

(b) retrieving the portion of said abandoned conductor extending above said depth;

(c) positioning means in fixed engagement with the upper end of the remaining portion of said abandoned conductor for deflecting the path of said replacement conductor; and (d) directing said replacement conductor along said predetermined path through said body of water until interaction with said deflecting means causes said replacement conductor to advance into the substratum in the direction of said deflected path so as to bypass said abandoned conductor and also causes the application of lateral pressure to the end of said abandoned conductor sufficient to cause the end of said abandoned conductor to shift position.

2. The method of claim 1 wherein said deflecting means comprises a downwardly sloping deflector trough disposed above and externally of the upper end of said remaining portion of said abandoned conductor.

3. The method of claim 2 wherein the said abandoned and replacement conductor is passed through a plurality of spaced apart guide sleeves carried on said fixed structure, whereby said replacement conductor is substantially unconstrained against lateral bending between the bottom most of said guide sleeves and the lower most portion of said deflector trough.

4. The method of claim 3 wherein the depth of the upper end of said remaining portion of said abandoned conductor is selected such that said lateral bending of said replacement conductor does not exceed a predetermined maximum.

5. The method of claim 4 wherein said lateral bending does not exceed 2° per 100 feet.

6. The method of claim 1 wherein said predetermined path is vertical.

7. A method of installing a new driven conductor on a fixed structure above a body of water as a replacement for a prior driven old conductor installed along a given slot path through said body of water comprising the steps of:

(a) retrieving the old conductor to a selected depth below the mudline, said depth being such that the upper end of said abandoned conductor will yield under lateral pressure;

(b) positioning a deflector trough in fixed engagement with the remaining portion of said old conductor for deflecting the path of said new conductor; and (c) directing said new conductor along said slot path through said body of water until interaction with said deflector trough causes said new conductor to advance into the substratum in the direction of said deflecting path and also causes the application of lateral pressure to the end of said abandoned conductor sufficient to cause the end of said abandoned conductor to shift position.

8. The method of claim 7 including the step of carrying said deflector trough to the old conductor by means of the new conductor.

9. The method of claim 8 including the step of continuing to lower said new conductor after engagement of said deflector with said old conductor so as to disengage said new conductor from said deflector trough by a shearing force.

10. The method of claim 8 wherein said deflector trough is adapted to slidably engage said original conductor.

11. The method of claim 7 wherein said deflector trough is carried into position by means of a section of drill pipe.

* * * * *

UNITED STATES PATENT AND TRADEMARK OFFICE

CERTIFICATE OF CORRECTION

PATENT NO. : 4,733,732

DATED : March 29, 1988

INVENTOR(S) : Samuel C. Lynch

It is certified that error appears in the above-identified patent and that said Letters Patent is hereby corrected as shown below:

Column 6, line 53, Claim 9, "trough" should be inserted after the word "deflector".

Signed and Sealed this

Twenty-seventh Day of December, 1988

*Attest:*

DONALD J. QUIGG

*Attesting Officer*

*Commissioner of Patents and Trademarks*